US007899204B2

(12) United States Patent
Kuribayashi et al.

(10) Patent No.: US 7,899,204 B2
(45) Date of Patent: Mar. 1, 2011

(54) SPEAKER

(75) Inventors: Ryo Kuribayashi, Mie (JP); Hiroyuki Morimoto, Mie (JP)

(73) Assignee: Panasonic Corporation, Osaka (JP)

( * ) Notice: Subject to any disclaimer, the term of this patent is extended or adjusted under 35 U.S.C. 154(b) by 1129 days.

(21) Appl. No.: 11/569,384

(22) PCT Filed: May 20, 2005

(86) PCT No.: PCT/JP2005/009225

§ 371 (c)(1),
(2), (4) Date: Nov. 20, 2006

(87) PCT Pub. No.: WO2005/117488

PCT Pub. Date: Dec. 8, 2005

(65) Prior Publication Data

US 2007/0183619 A1 Aug. 9, 2007

(30) Foreign Application Priority Data

May 27, 2004 (JP) ..... 2004-157394

(51) Int. Cl.
*H04R 25/00* (2006.01)

(52) U.S. Cl. ..... 381/423; 381/398; 381/424; 381/412

(58) Field of Classification Search ..... 381/412, 381/433, 423, 424, 398
See application file for complete search history.

(56) References Cited

U.S. PATENT DOCUMENTS

| | | | | |
|---|---|---|---|---|
| 4,881,617 | A * | 11/1989 | Faraone | 181/164 |
| 6,567,529 | B1 | 5/2003 | Roark | |
| 6,863,153 | B1 * | 3/2005 | Hayakawa et al. | 181/173 |
| 2006/0062421 | A1 | 3/2006 | Kuribayashi et al. | |

FOREIGN PATENT DOCUMENTS

| | | |
|---|---|---|
| EP | 05 74 1576 | 6/2010 |
| GB | 1270033(A) | 4/1972 |
| GB | 1488541(A) | 10/1977 |
| JP | 07-162992 | 6/1995 |
| JP | 2000-092591 | 3/2000 |
| JP | 2000-217192 | 8/2000 |
| JP | 2003-259486 | 9/2003 |
| JP | 2005-123779 | 5/2005 |
| WO | WO 9510165(A) | 4/1995 |

OTHER PUBLICATIONS

International Search Report for application No. PCT/JP2005/009225 dated Sep. 6, 2005.

* cited by examiner

*Primary Examiner* — Suhan Ni
*Assistant Examiner* — Jasmine Pritchard
(74) *Attorney, Agent, or Firm* — RatnerPrestia

(57) ABSTRACT

A speaker is disclosed in which a split resonance of a diaphragm main body and a natural resonance of an edge are controlled, achieving a high sound quality while realizing a weight reduction. A diaphragm is composed of a diaphragm main body and an edge. An outer peripheral part of the diaphragm main body is bonded with a peripheral edge of a frame through the edge. An external shape of edge is formed in substantially a perfect circle. While, at least one of the outer peripheral part of the diaphragm main body and an inner peripheral part of the edge, which is a mutual bonding portion, is formed in a different shape than the perfect circle.

11 Claims, 10 Drawing Sheets

SPEAKER

This application is a U.S. National Phase Application of PCT International Application PCT/JP2005/009225.

TECHNICAL FIELD

The present invention relates to a speaker to be used for various electronic devices.

BACKGROUND OF THE INVENTION

An example of a conventional speaker is described in Japanese Patent Unexamined Publication No. H07-162992. FIG. 11 is a cross-sectional view of a conventional speaker showing a construction of the speaker.

In FIG. 11, the conventional speaker includes lower plate 20, magnet 21, upper plate 22, frame 24, diaphragm 25, edge 26, voice coil 27, dumper 28, and dust cap 29. Lower plate 20 is made of magnetic material, and pole 20*a* is formed at a center of lower plate 20. Magnet 21 is formed in a ring shape. A magnet for a speaker application is generally made of a material of neodymium group or of ferrite group, as magnet 21. Upper plate 22 is also formed in a ring shape and is made of magnetic material. Upper plate 22, magnet 21 and lower plate 20 constitute magnetic circuit 23. Magnetic gap 23*a* is formed in a ring shape between a peripheral wall of pole 20*a* of lower plate 20 and an inner peripheral wall of upper plate 22.

Frame 24 is bonded with upper plate 22 at a center of frame 24. Diaphragm 25 is bonded through edge 26 to a peripheral edge of frame 24 at a outer peripheral part of diaphragm 25, and an inner peripheral part of the diaphragm 25 is bonded with voice coil 27 placed in magnetic gap 23*a* in a freely movable manner.

Damper 28 is bonded with voice coil 27 at an inner peripheral part of damper 28, and an outer peripheral part of damper 28 is bonded with frame 24, thus supporting voice coil 27. Dust cap 29 is a dust-roofing cover attached to an upper center part of diaphragm 25.

Thus constituted conventional speaker generates an up and down amplitude movements of voice coil 27 with a sound signal inputted from an outside source (not illustrated) converted to a mechanical signal by the Fleming's left-hand rule, vibrating diaphragm 25 bonded with voice coil 27 and reproducing a sound.

In recent years, various electronic devices require that speakers using for the electronic devices reproduce a higher-quality sound. In-car speakers are especially required a light in weight with the high-quality sound. For this reason, many proposals are made for improving magnetic circuit 23 and diaphragm 25.

For example, diaphragm 25 is made lighter in weight by reducing a thickness of material or by using a material in a low density. However, diaphragm 25 which is made lighter in this way has lower modulus of elasticity, causing a split resonance of diaphragm 25, or causing a resonance of edge 26 bonded with the outer peripheral part of diaphragm 25. FIG. 12 exemplarily shows graphical data indicating a frequency characteristic of a conventional speaker. A unit of a vertical axis, which indicates a sound pressure characteristic 111, second-harmonic distortion characteristic 112 and third-harmonic distortion characteristic 113, is in dB SPL (Sound Pressure Level). A unit of a vertical axis, which indicates impedance characteristic 114, is in ohm. The characteristic of a sound pressure level versus frequency is sometimes called a SPL characteristic, hereinafter.

In order to control the split resonance, the inventors of this invention proposed a technique in Japanese Patent Application No. 2003-354832. The technical can control the split resonance of diaphragm 25, however, it is difficult to control the resonance of edge 26, so is hard to realize both of the requirement, light in weight and the high sound quality.

SUMMARY OF THE INVENTION

The present invention provides a speaker realizing both light in weight and high sound quality at one time.

The speaker of the present invention includes a magnetic circuit, a frame and a diaphragm. The magnetic circuit has a magnetic gap in a ring shape. The frame is bonded with the magnetic circuit at a central part of the frame. The diaphragm is bonded with a voice coil placed in the magnetic gap in a freely movable manner at a central part of the diaphragm, and the outer peripheral part of the diaphragm is bonded with a peripheral edge of the frame through an edge. An external shape of the edge bonded with the outer peripheral part of the diaphragm is formed in a perfect circle, and at least one of the outer peripheral part of the diaphragm and an inner peripheral part of the edge, which becomes a mutual bonding portion, is formed in a different shape than the perfect circle.

This constitution controls split resonance, thereby providing a speaker which realizes both the light in weight and high sound quality.

One other speaker according to the present invention includes a magnetic circuit, a frame and a diaphragm. The magnetic circuit has a magnetic gap in a ring shape. The frame is bonded with the magnetic circuit at a central part of the frame. The diaphragm is bonded with a voice coil placed in the magnetic gap in a freely movable manner at a central part of the diaphragm, and the outer peripheral part of the diaphragm is bonded with a peripheral edge of the frame through an edge. An internal shape and an external shape of the edge, and an external shape of the diaphragm are formed in a perfect circle respectively. The diaphragm and the edge can be overlaid with respective center shifted each other and are bonded together.

With this constitution, the split resonance is further controlled, thereby providing a speaker achieving both a light in weight and high sound quality.

REFERENCE MARKS IN THE DRAWING

Figure 1:
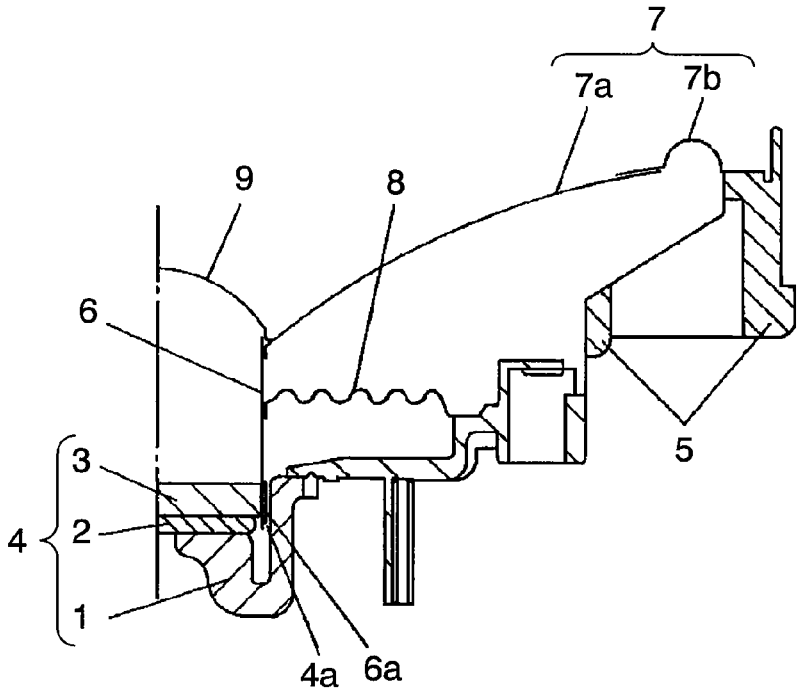
FIG. 1 is a half sectional view for showing a structure of a speaker in accordance with a first exemplary embodiment of the present invention.

1 yoke
2 magnet
3 top plate
4 magnetic circuit
4*a* magnetic gap
5 frame
6 voice coil
6*a* coil portion
7, 10, 11 diaphragm
7*a*, 10*a*, 11*a* diaphragm main body
7*b*, 10*b*, 11*b* edge
7*c*, 10*c*, 11*c* bonding portion
8 damper
9 dust cap
10*d* thick portion
10*e* quasi-thick portion
10*f* thin portion
31, 51, 61, 71, 81 sound pressure characteristic
32, 52, 62, 72, 82 second-harmonic distortion characteristic
33, 53, 63, 73, 83 third-harmonic characteristic
34, 54, 64, 74, 84 impedance characteristic

DETAILED DESCRIPTION OF THE DRAWINGS

Exemplary embodiments of the invention are explained hereinafter using the drawings.

First Exemplary Embodiment

FIG. 1 is a half sectional view for showing a structure of a speaker in accordance with the first exemplary embodiment of the present invention. The speaker as shown in FIG. 1 includes yoke 1, magnet 2, top plate 3, frame 5, voice coil 6, diaphragm 7, damper 8 and dust cap 9. Yoke 1 is made of magnetic material, with its bottom central portion protruded upward. Yoke 1 has an external wall in a cylindrical shape. Magnet 2 is in a disk shape and is generally made of a material of ferrite group or of neodymium group. Top plate 3 is made of magnetic material and formed in a disk shape. Yoke 1, magnet 2 and top plate 3 are overlaid and bonded together, constituting magnetic circuit 4. Magnetic gap 4*a* is formed in a ring shape between yoke 1 and top plate 3, between an inner peripheral side of the cylindrical wall of the yoke 1 and an outer peripheral side of the top plate 3.

Frame 5 is made of resin. Magnetic circuit 4 is attached to a center of frame 5. More concretely, frame 5 is bonded with yoke 1 with an adhesive, otherwise yoke 1 can be press-fit to frame 5. Yoke 1 can also be fit into frame 5 by an already known method such as outsert-molding. Voice coil 6 is placed in magnetic gap 4*a* in a freely movable manner where magnetic circuit 4 is formed with coil portion 6*a*.

Diaphragm 7 is composed of diaphragm main body 7*a* in a cone shape and edge 7*b* in a ring shape, details of which are described later. Edge 7 is attached to an outer peripheral part of diaphragm main body 7*a*. Damper 8 is attached to voice coil 6 at an inner peripheral part of damper 8. Damper 8 is attached to frame 5 at an outer peripheral part of damper 8. So damper 8 sustains voice coil 6. Dust cap 9 is a dust-proofing cap attached to an upper center part of diaphragm 7.

Figure 2:
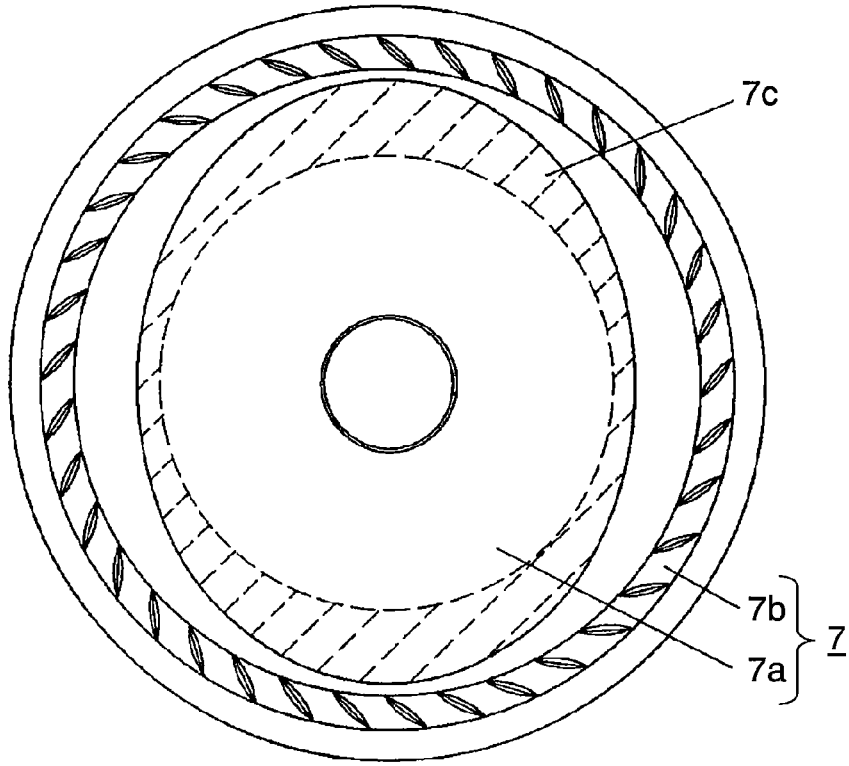
FIG. 2 is a plan view of a diaphragm to be used for the speaker, viewed from a rear side.

FIG. 2 is a plan view of diaphragm 7 of the speaker in accordance with the present exemplary embodiment, viewed from a rear side. In FIG. 2, edge 7*b* is attached to the outer peripheral part of diaphragm main body 7*a*, with forming a ring shape. Edge 7*b* is formed in a substantially perfect circle both in the inner peripheral part and the outer peripheral part. The word of the perfect circle includes a substantially perfect circle, hereinafter. The other hand, the outer peripheral part of diaphragm main body 7*a* is formed in an oval shape. The outer peripheral part of diaphragm 7*a* formed in the oval shape and the inner peripheral part of edge 7*b* formed in the perfect circle are overlaid and bonded together at bonding portion 7*c*, a hatched portion of the drawing.

Figure 3:
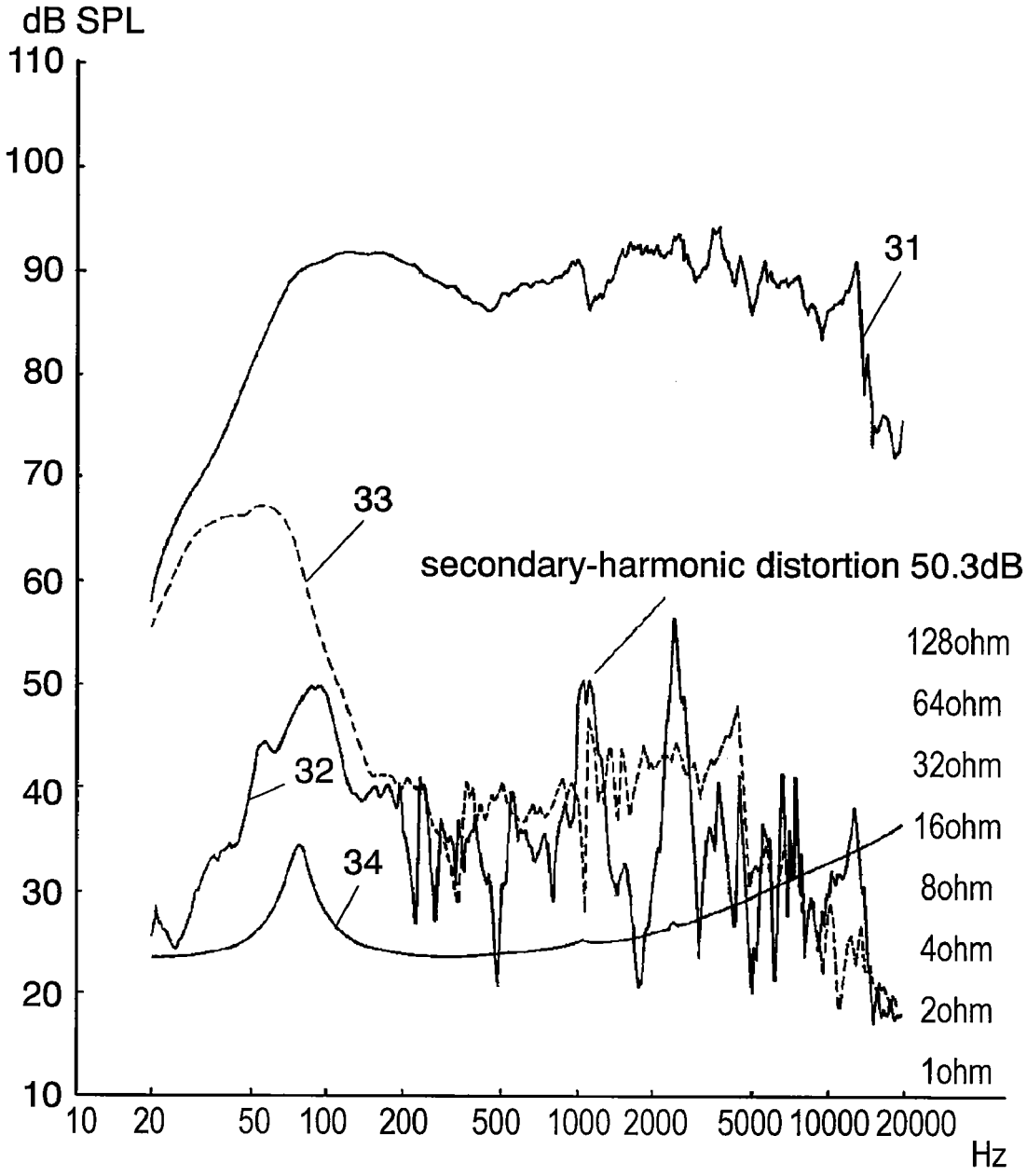
FIG. 3 is a characteristic diagram showing a frequency characteristic of the speaker.

By constituting diaphragm 7 as above, the shape of diaphragm 7 including edge 7*b* is formed partially asymmetric, making a specific frequency derived from a natural resonance of edge 7*b* to be different. Thus, by controlling the natural resonance of edge 7*b*, a good characteristic of sound pressure level versus frequency can be obtained. FIG. 3 is a characteristic diagram of the sound pressure vs. frequency of a 16 cm bore diameter speaker manufactured in accordance with the exemplary embodiment of the present invention.

In FIG. 3, a unit of the vertical axis, which indicates sound pressure characteristic 31, second-harmonic distortion characteristic 32 and third-harmonic distortion characteristic 33, is in dB SPL, and a unit of the vertical axis, which indicates impedance characteristic 34, is in ohm.

According to FIG. 3, the speaker in accordance with the exemplary embodiment of the present invention, second-harmonic distortion derived from the natural resonance is reduced by about 7 dB than a conventional speaker, because the natural resonance of edge 7*b* is controlled.

In this exemplary embodiment, a case is explained that edge 7*b* is formed in a perfect circle both in the outer peripheral part and the inner peripheral part, that the outer peripheral part of diaphragm main body 7*a* is formed in an oval shape, and that the outer peripheral part of diaphragm 7*a* formed in the oval shape and the inner peripheral part of edge 7*b* formed in the perfect circle are overlaid and bonded together. However, the present invention is not limited to this case. As long as the outer peripheral part of edge 7*b* is formed in a perfect circle, one of the outer peripheral part of diaphragm main body 7*a* and the inner peripheral part of edge 7*b*, which becomes the bonding part of the other, can be formed in a different shape than the perfect circle.

Figure 4:
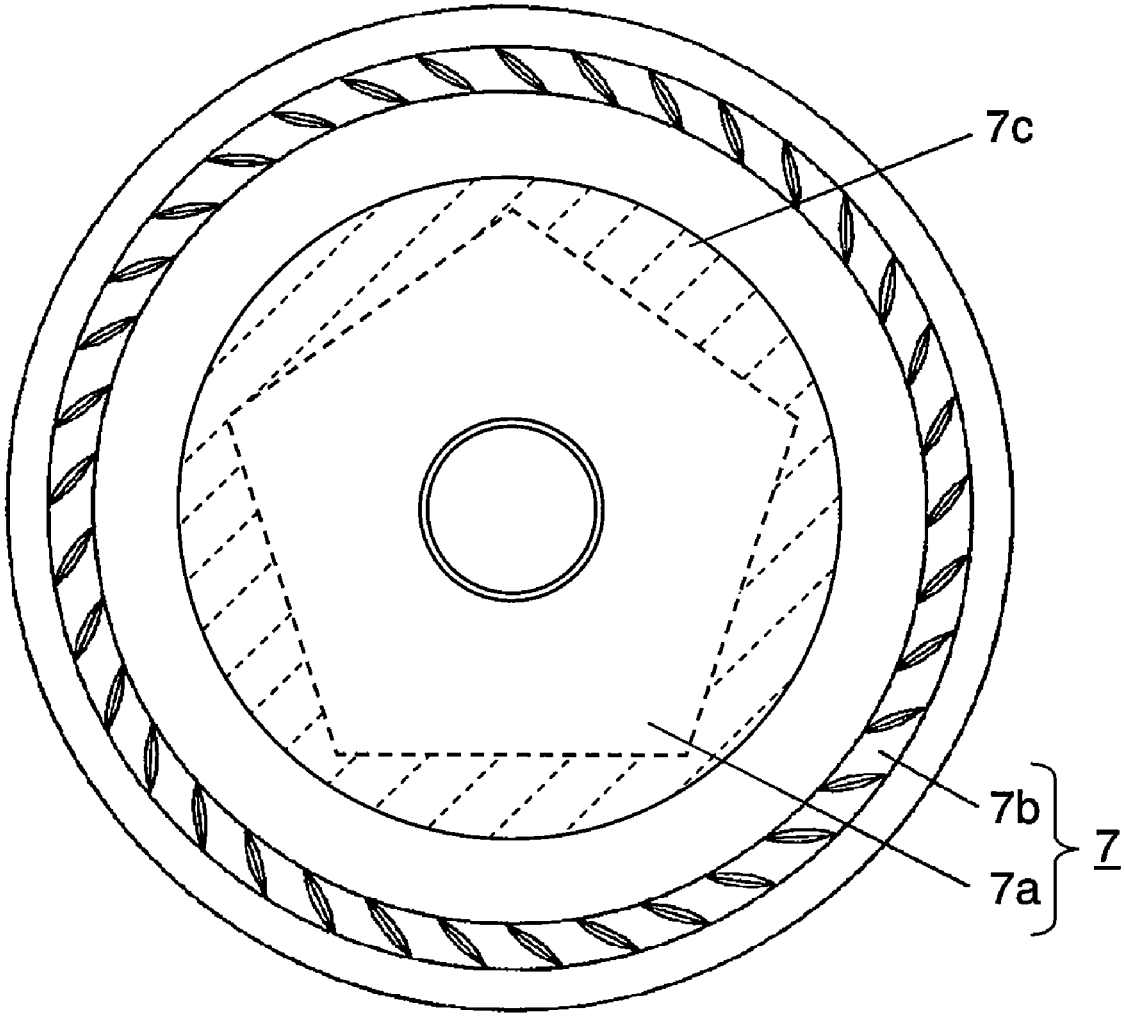
FIG. 4 is a plan view of a diaphragm to be used for the speaker, viewed from a rear side.

Further, as long as the shape is different from the perfect circle, the shape can be an even number polygonal shape or an odd number polygonal shape, as well as it can be an oval shape. FIG. 4 is a plan view of diaphragm 7 of a speaker in accordance with the exemplary embodiment of the present invention, viewed from a rear side. An outer peripheral part of diaphragm main body 7*a* is formed in a perfect circle, then the outer peripheral part of diaphragm main body 7*a* formed in the perfect circle and an inner peripheral part of edge 7*b* formed in a pentagon shape are overlaid and bonded together. Because the natural resonance of edge 7*b* is caused at distorted frequencies of even number, much preferable shape of edge 7*b* is either an oval or an odd number polygon.

Second Exemplary Embodiment

A speaker in accordance with the second exemplary embodiment in the present invention is different from the first exemplary embodiment in a structure of the diaphragm. Structure other than the diaphragm is the same as that of the first exemplary embodiment, so the same numerical reference is given to an identical part and its detailed explanation is omitted. Below, only different parts are explained using the drawings.

Figure 5:
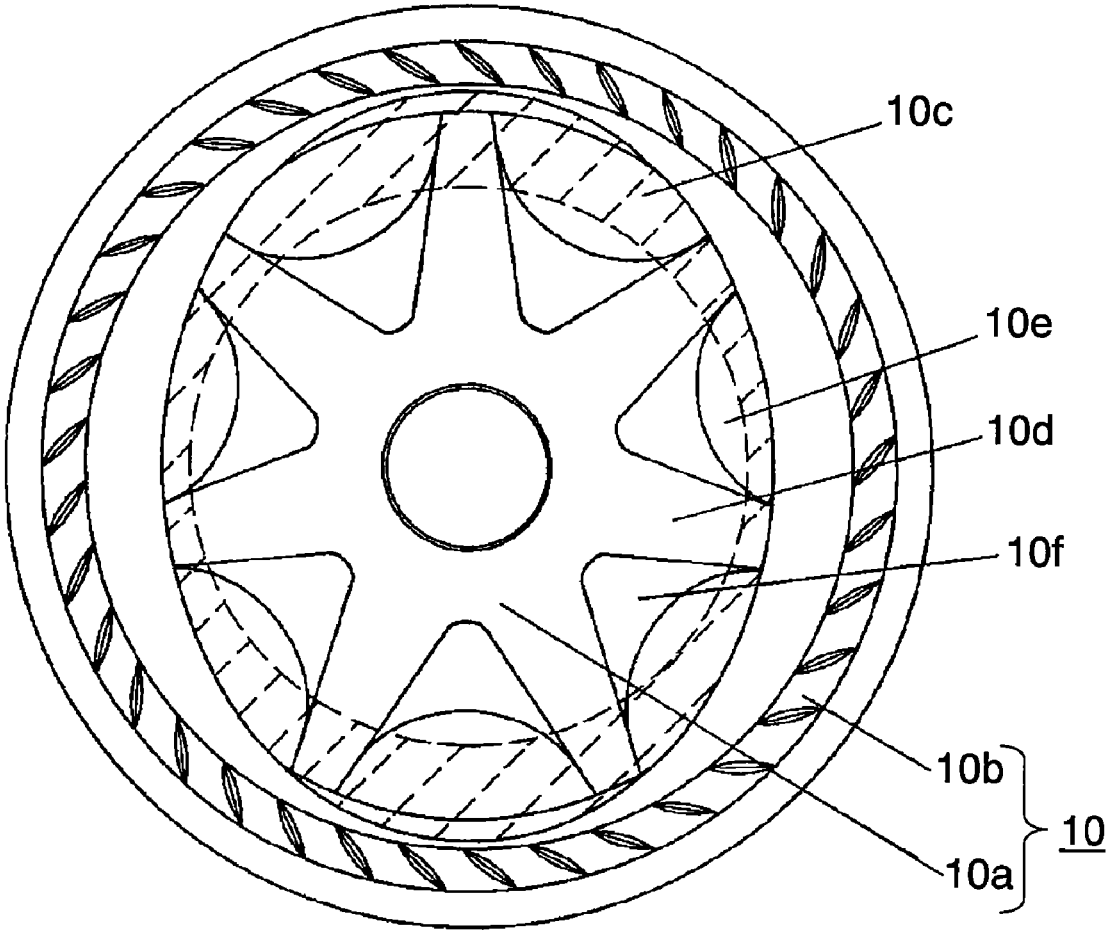
FIG. 5 is a plan view of a diaphragm to be used for a speaker in accordance with a second exemplary embodiment of the present invention, viewed form a rear side.

FIG. 5 is a plan view of a diaphragm to be used for the exemplary embodiment of the present invention. In FIG. 5, diaphragm 10 is composed of diaphragm main body 10*a* in a cone shape and edge 10*b* in a ring shape. Edge 10*b* is bonded with an outer peripheral part of diaphragm main body 10*a*. Edge 10*b* is formed in a perfect circle both in an outer peripheral part and an inner peripheral part thereof. The outer peripheral part of diaphragm main body 10*a* is formed in an oval shape. The outer peripheral part of diaphragm main body 10*a* formed in the oval shape and an inner peripheral part of edge 10*b* formed in the perfect circle are overlaid and bonded together at bonding portion 10*c*. This structure is the same as the one in the first exemplary embodiment.

Diaphragm main body 10*a* includes thick portion 10*d*, quasi-thick portion 10*e* and thin portion 10*f*. Seven thick portions 10*d* are extended radially from a central part of diaphragm main body 10*a* with a substantially same angle between each other. Quasi-thick portion 10*e* is formed between radially extended thick portions 10*d* and its thickness is becoming thinner as it goes from outer peripheral part toward the center of diaphragm main body 10*a*. Thin portion 10*f* is formed in substantially web-like shape toward an inner side of quasi-thick portion 10*e*. Above described, diaphragm main body 10*a* is similar to the diaphragm which the inventors of this invention claimed for a patent in Japanese Patent Application No. 2003-354832.

For example, diaphragm main body 10*a* is made of polypropylene and is injection-molded into a bore diameter of 16 cm, average thickness of thick portion 10*d*: t=0.25 mm, and average thickness of thin portion 10*f*: t=0.15 mm.

With the speaker in accordance with the exemplary embodiment, diaphragm 10 is so constituted that new effects are added to the first exemplary embodiment. Namely, thick portion 10*d* disposed in odd number prevents a line-symmetric portion to be formed in diaphragm main body 10*a*. Still more, quasi-thick portion 10*e* enforces bending rigidity of diaphragm main body 10*a* from the central part toward an outer direction, preventing a split resonance to be caused at a natural resonance mode. Split resonance which is caused along the peripheral part by the natural resonance mode is also prevented by quasi-thick portion 10*e*. With these arrangements, the split resonance of diaphragm main body 10*a* and the natural resonance of edge 10*b* are controlled, providing the speaker with a good sound pressure vs. frequency characteristic.

Figure 6:
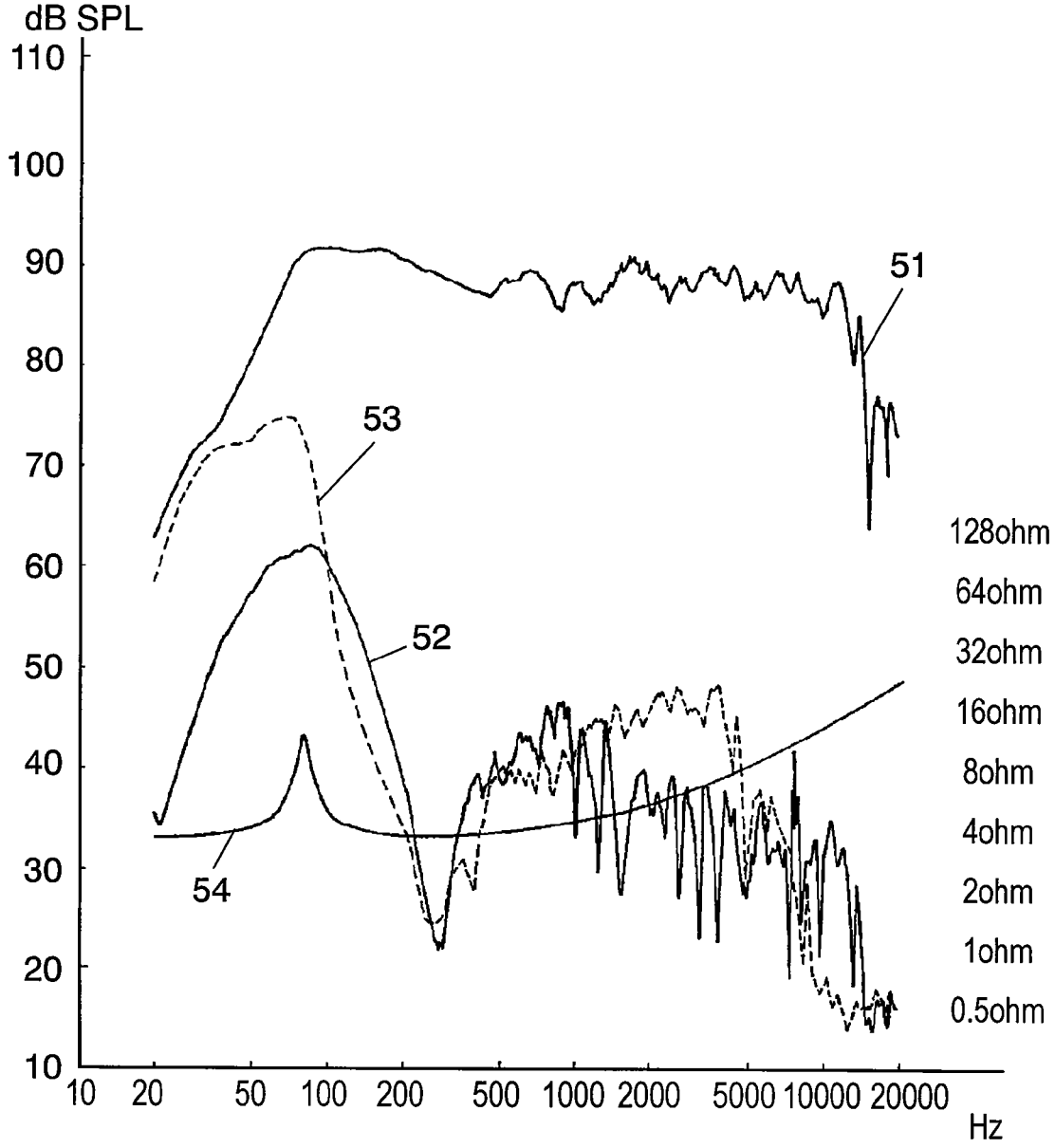
FIG. 6 is a characteristic diagram showing a frequency characteristic of the speaker.

FIG. 6 is a characteristic diagram showing a frequency characteristic of a 16 cm bore diameter speaker manufactured in accordance with the exemplary embodiment. In FIG. 6, a unit of the vertical axis, which indicates sound pressure characteristic 51, second-harmonic distortion characteristic 52 and third-harmonic distortion characteristic 53, is in dB SPL, and a unit of the vertical axis, which indicates impedance characteristic 54, is in ohm.

According to data in FIG. 6, because of the effects of thick portion 10*d* and quasi-thick portion 10*e*, deviation in SPL characteristic of the speaker is improved by 4 dB at a frequency band between 2 kHz and 10 kHz, from 10 dB of the conventional speaker to 6 dB of the speaker in accordance with the exemplary embodiment. By the similar effect of the first exemplary embodiment, natural resonance in edge 10*b* is controlled so a causing second-harmonic distortion is reduced by about 9 dB.

The natural resonance of edge 10*b* is controlled differently depending on how oval diaphragm main body 10*a* is formed. Actually, the difference in the control depends on how thick portion 10*d*, quasi-thick portion 10*e* and thin portion 10*f* are disposed, when the outer peripheral part of diaphragm main body 10*a* formed in the oval shape and the inner peripheral part of edge 10*b* formed in a perfect circle are overlaid and bonded together. By utilizing the difference, sound characteristic can be arbitrarily controlled. Such difference is explained in FIG. 7 to FIG. 9.

Figure 7:
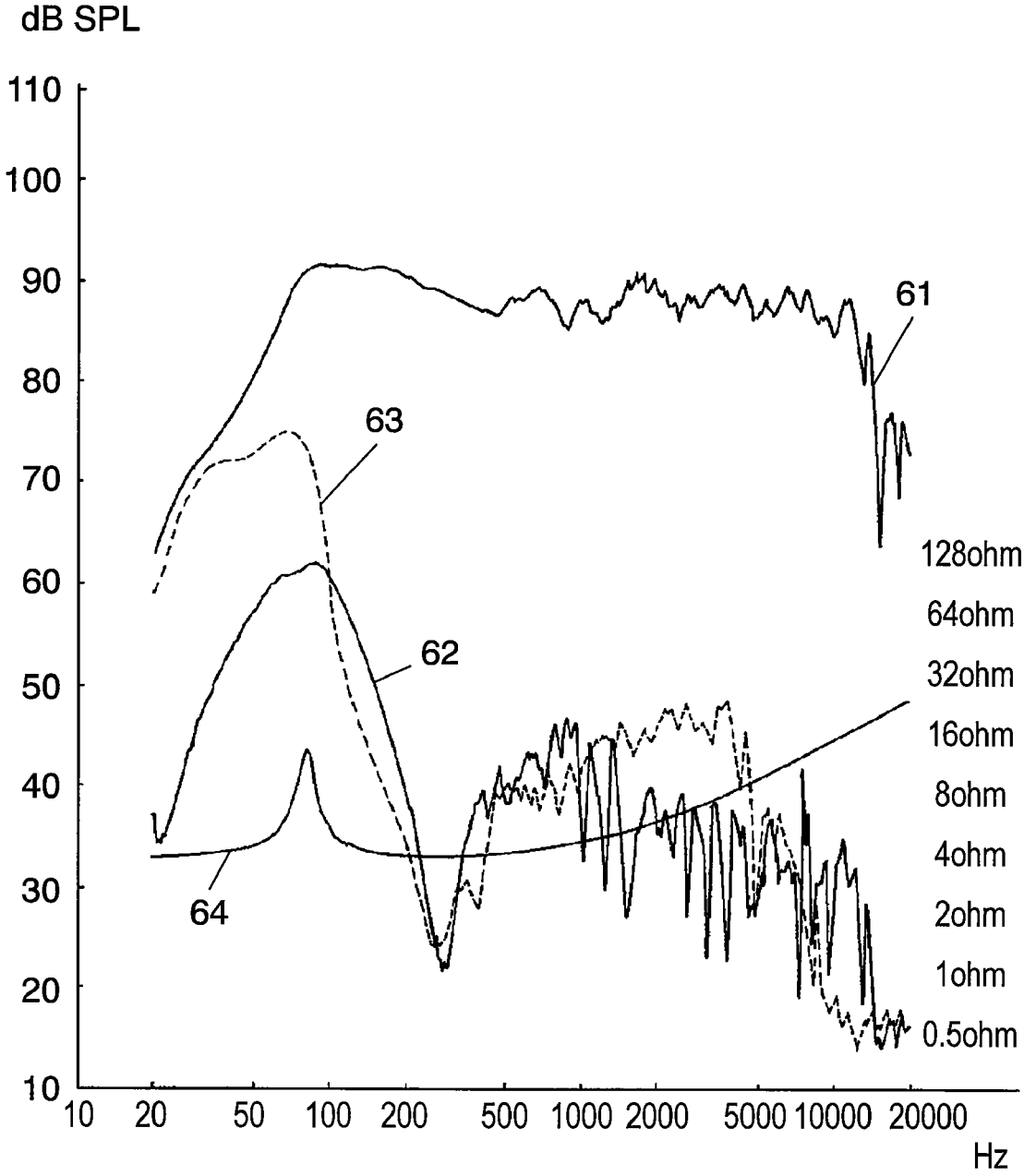
FIG. 7 is a characteristic diagram showing a frequency characteristic of the speaker.
Figure 8:
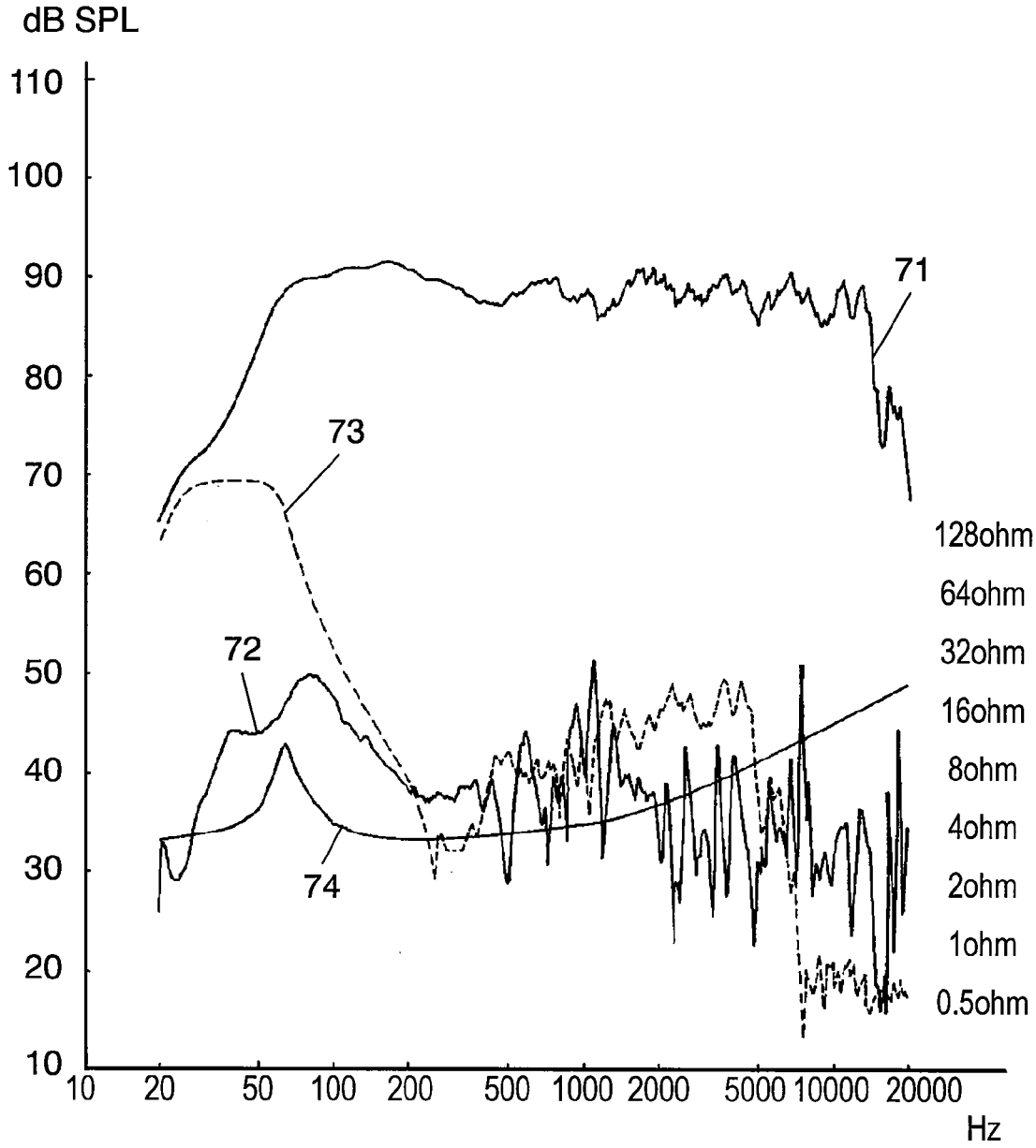
FIG. 8 is a characteristic diagram showing a frequency characteristic of the speaker.
Figure 9:
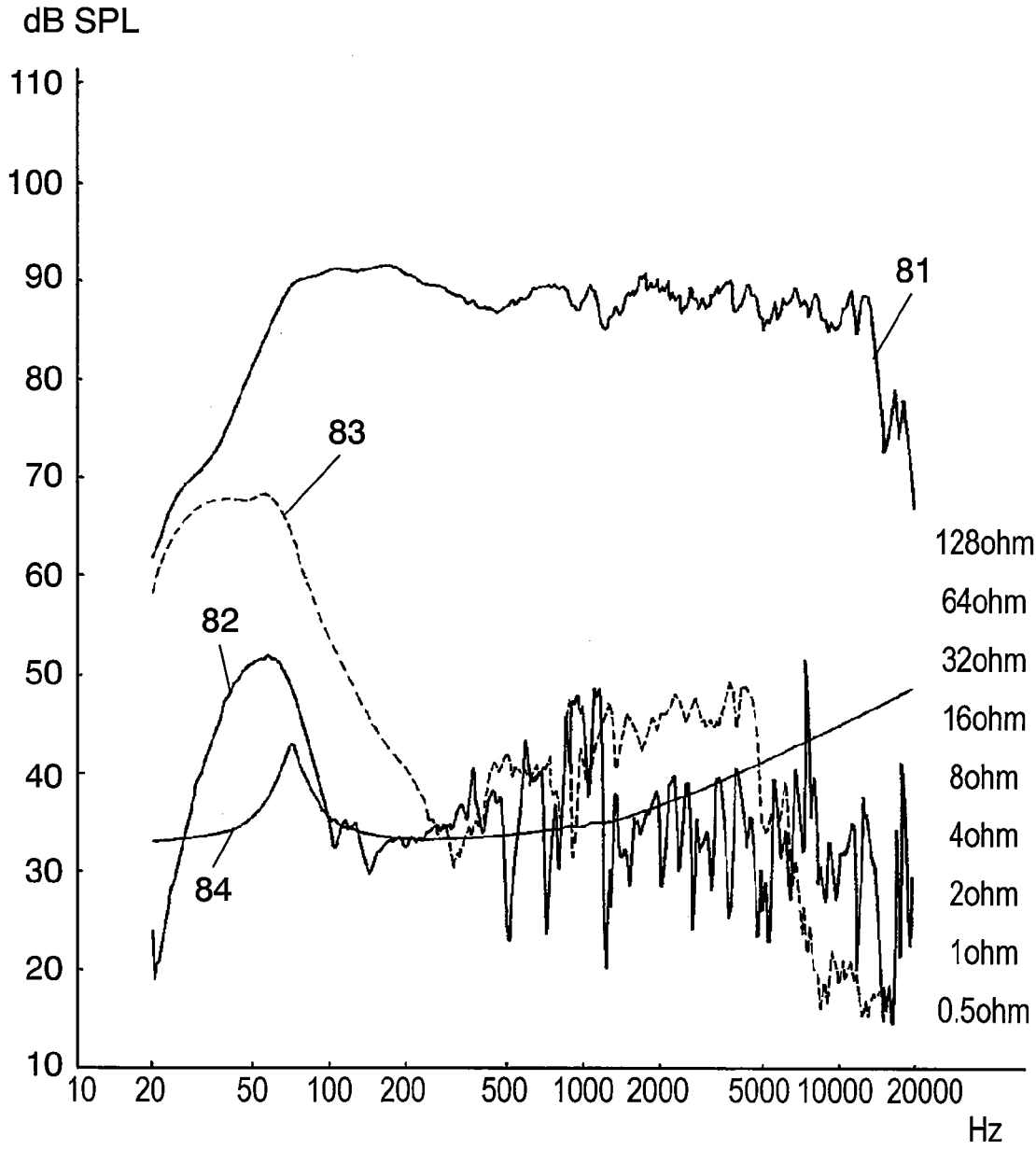
FIG. 9 is a characteristic diagram showing a frequency characteristic of the speaker.

FIGS. 7 to 9 are characteristic diagrams showing a frequency characteristic of a speaker in accordance with the second exemplary embodiment of the present invention. They indicate SPL characteristics of a case in which the inner peripheral part of edge 10*b* formed into a perfect circle and the outer peripheral part of diaphragm main body 10*a* formed into an oval shape are bonded together. FIG. 7 indicates a SPL characteristic of a speaker in which thick potion 10*d* is disposed along a longer diameter of the oval shape. FIG. 8 indicates a SPL characteristic of a speaker in which a middle part of thick portion 10*d* and quasi-thick portion 10*e* is disposed along the longer diameter of the oval. FIG. 9 indicates a SPL characteristic of a speaker in-between one of FIG. 7 and one of FIG. 8.

Comparing the SPL characteristics in FIG. 7 to FIG. 9, following facts can be identified. The speaker having the characteristic shown in FIG. 7 in which thick portion 10*d* is disposed along the longer diameter in the oval shape can reduce most effectively the second-harmonic distortion derived from the natural resonance of edge 10*b*, reproducing a sound clearly.

The speaker having the characteristic shown in FIG. 8 in which the middle part of thick portion 10*d* and quasi-thick portion 10*e* is disposed along the longer diameter of the oval causes little larger second-harmonic distortion derived from the natural resonance of edge 10*b* as compared with FIG. 7. However, with the speaker, a frequency band where a sound pressure level falls down due to natural resonance of edge 10*b*, so-called "a midrange valley", can be narrowed. Consequently, bits fall of musical information can be most effectively minimized, enabling the speaker to reproduce the original sound in high fidelity.

In this exemplary embodiment, a case having seven thick portions 10*d* is explained. However, the invention is not limited to this case. As long as three or more odd-number thick portions 10*d* are disposed in substantially a same angle and a space, a similar effect can be obtained.

In the explanation of the exemplary embodiment of the invention, thick portion 10*d* and quasi-thick portion 10*e* are disposed at the rear side of diaphragm 10. As in this arrangement, by not having an uneven front surface on diaphragm 10 of thick portion 10*d* and quasi-thick portion 10*e*, phase disturbance of an acoustic wave caused by vibration of diaphragm 10 can be prevented.

Third Exemplary Embodiment

The speaker in accordance with the third exemplary embodiment is different from the speaker in the first exemplary embodiment in a structure of a diaphragm. Other structure is identical to that of the first exemplary embodiment, so that a same numerical reference is used for the identical part and detailed explanation of it is omitted. Below, only different parts are explained using the drawing.

Figure 10:
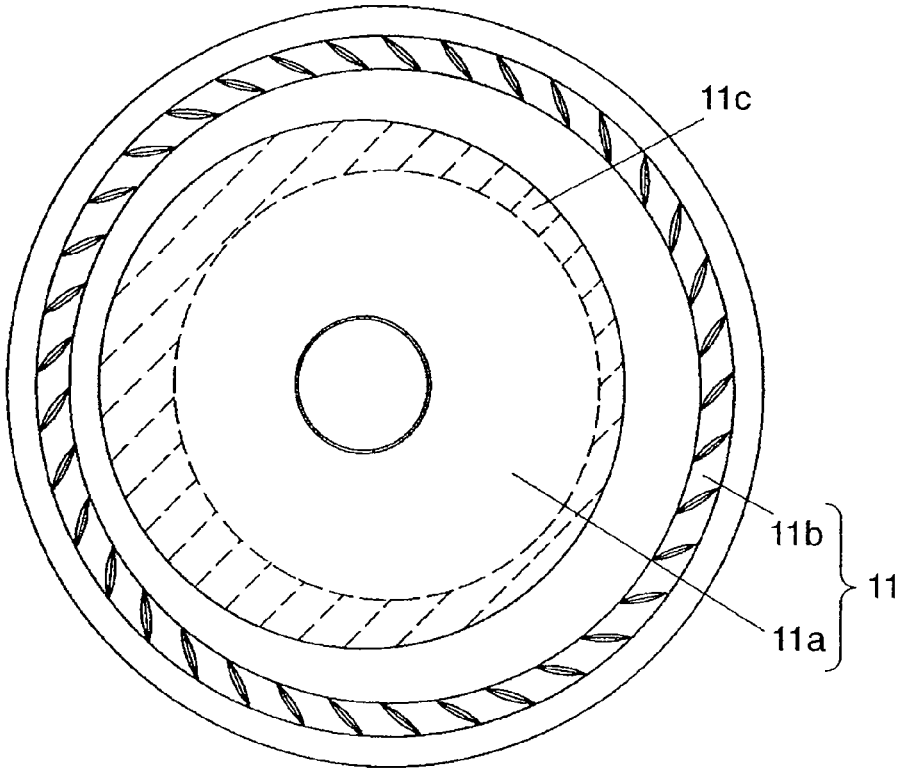
FIG. 10 is a plan view of a diaphragm to be used for a speaker in accordance with a third exemplary embodiment of the present invention, viewed from a rear side.
Figure 11:
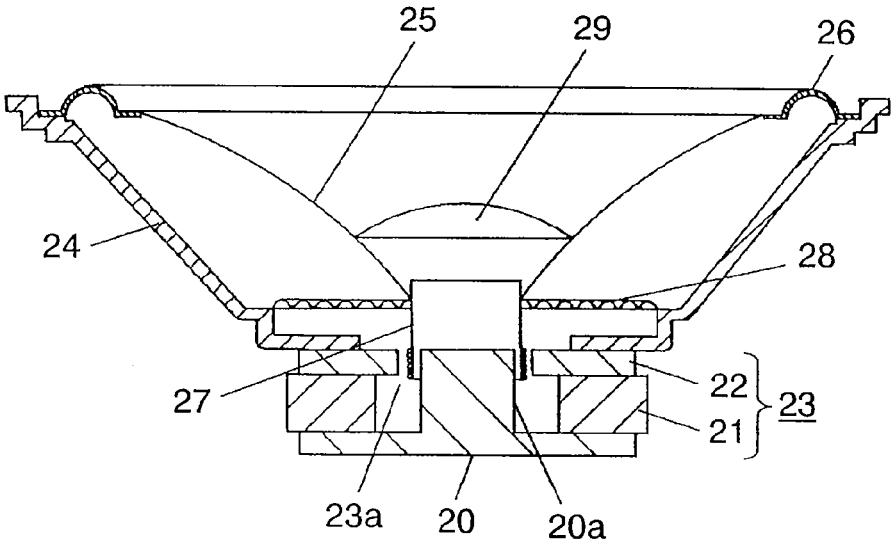
FIG. 11 PRIOR ART
FIG. 11 is a cross-sectional view showing a structure of a conventional speaker.
Figure 12:
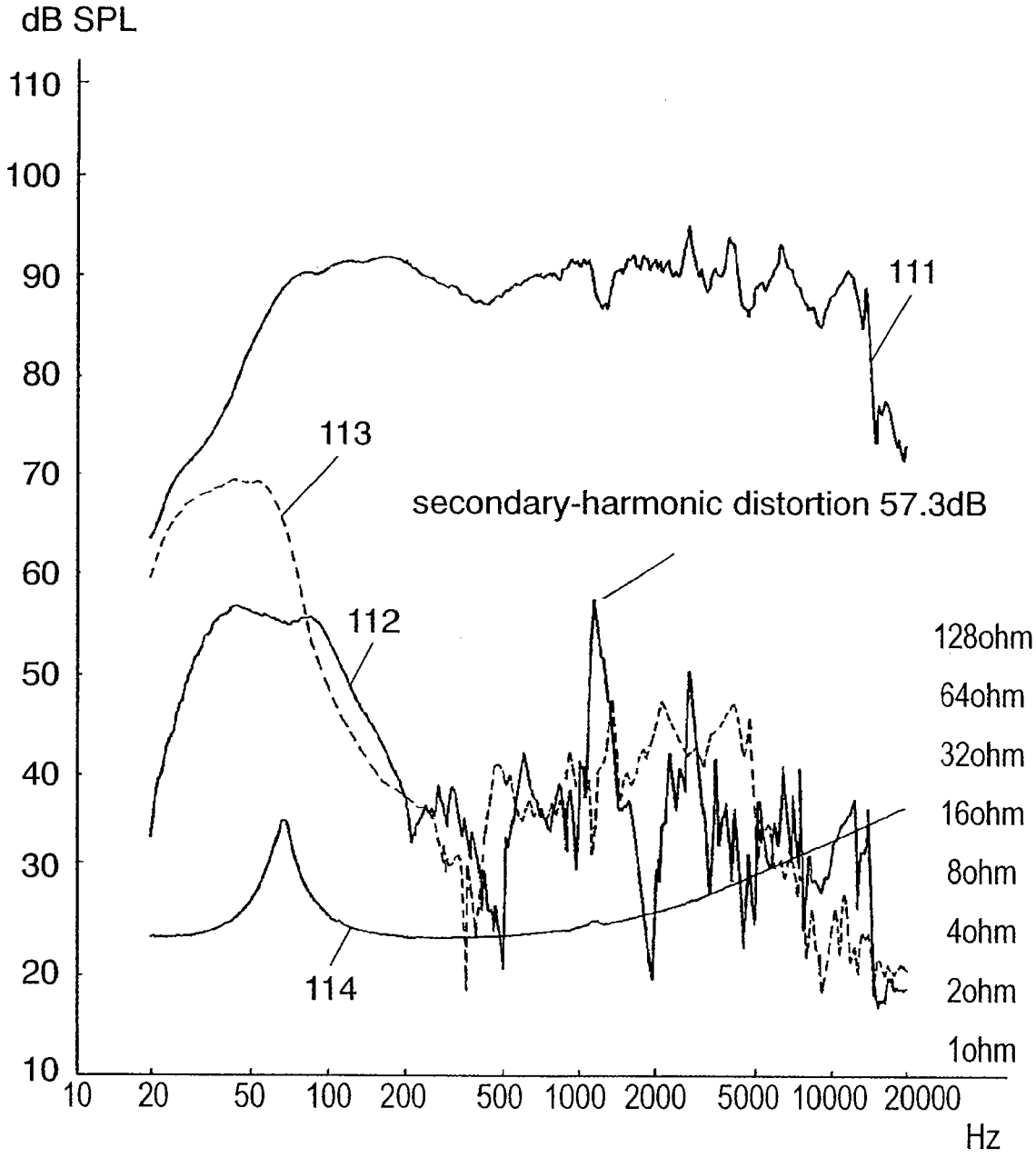
FIG. 12 PRIOR ART
FIG. 12 is a characteristic diagram showing a frequency characteristic of the speaker.

FIG. 10 is a plan view of a diaphragm used for a speaker in accordance with the third exemplary embodiment, viewed from a rear side. In FIG. 10, diaphragm 11 is composed of diaphragm main body 11*a* in a cone shape and edge 11*b* formed in a ring shape. Edge 11*b* is attached to an outer peripheral part of diaphragm main body 11*a*. Edge 11*b* is formed in a perfect circle both in an inner peripheral part and an outer peripheral part, which is the same as that of the first exemplary embodiment.

Diaphragm main body 11*a* is also shaped in a perfect circle shape in its outer peripheral part. The outer peripheral part of diaphragm main body 11*a* formed in the perfect circle and the inner peripheral part of edge 11*b* formed in the perfect circle are overlaid except for each center shifted from the other, and both are bonded together at bonding portion 11*c*.

With the above structured speaker in accordance with the exemplary embodiment, the shape of the diaphragm including the edge becomes partially asymmetric, similar to the cases where the outer peripheral part of the diaphragm main body is formed into a shape other than the perfect circle in the first and the second exemplary embodiments. Thus, with the speaker in accordance with the exemplary embodiment, specific frequency derived from the natural resonance of the edge is made different. By controlling the natural resonance of the edge in this manner, a good sound pressure vs. frequency characteristic is obtained. With the speaker, the split resonance of the diaphragm can also be controlled similarly with the second exemplary embodiment, if thick portions and quasi-thick portions in odd-number are disposed onto the diaphragm, and if the thin-portions in the web-like shape are further added to the rear side of diaphragm main body 11*a*.

INDUSTRIAL APPLICABILITY

The speaker according to the present invention can control a split resonance of a diaphragm main body and a natural resonance of an edge, therewith providing a good sound pressure versus frequency characteristic, namely a high sound quality. The speaker is useful for a variety of electronic devices including an audio instrument and an in-car acoustic device.

The invention claimed is:

1. A speaker comprising:

a magnetic circuit having a magnetic gap formed in a ring shape;

a frame bonded with the magnetic circuit in a central part of the frame; and a diaphragm of which a central part is bonded with a voice coil placed in the magnetic gap in a freely movable manner and of which an outer peripheral part is bonded with a peripheral edge of the frame through an edge, wherein an external shape of the edge bonded with the outer peripheral part of the diaphragm is formed in a circle;

wherein at least one of the outer peripheral part of the diaphragm and an inner peripheral part of the edge is formed in a different shape than the circle; and wherein the amount of an overlap between the diaphragm and the edge varies about the voice coil.

2. The speaker of claim 1, wherein the different shape than the circle is an oval or a polygon.

3. The speaker of claim 1, wherein the diaphragm is composed of at least three or more of thick portions in odd number radially extended from the central part toward the outer peripheral part of the diaphragm, and a quasi-thick portion formed between the thick portions with a thickness of the quasi-thick portion becoming thinner from the outer peripheral part toward an inside of the diaphragm.

4. The speaker of claim 3, wherein a thin portion is formed at an inner part of the quasi-thick portion.

5. The speaker of claim 4, wherein the thick portions and the quasi-thick portions are formed at a rear side of the diaphragm.

6. The speaker of claim 3, wherein the thick portions and the quasi-thick portions are formed at a rear side of the diaphragm.

7. A speaker comprising:

a magnetic circuit having a magnetic gap formed in a ring shape;

a frame bonded with the magnetic circuit in a central part of the frame; and a diaphragm of which a central part is bonded with a voice coil placed in the magnetic gap in a freely movable manner and of which an outer peripheral part is bonded with a peripheral edge of the frame through an edge, wherein an internal shape and an external shape of the edge, and an external shape of the diaphragm are respectively formed in a circle; and wherein the diaphragm and the edge are overlaid with respective centers being shifted relative to each other and are bonded together.

8. The speaker of claim 7, wherein the diaphragm is composed of at least three or more of thick portions in odd number radially extended from the central part toward the outer peripheral part of the diaphragm, and a quasi-thick portion formed between the thick portions with a thickness of the quasi-thick portion becoming thinner from the outer peripheral part toward an inside of the diaphragm.

9. The speaker of claim 8, wherein a thin portion is formed at an inner part of the quasi-thick portion.

10. The speaker of claim 9, wherein the thick portions and the quasi-thick portions are formed at a rear side of the diaphragm.

11. The speaker of claim 8, wherein the thick portions and the quasi-thick portions are formed at a rear side of the diaphragm.

* * * * *